US007729641B2

(12) United States Patent
Suzuki

(10) Patent No.: US 7,729,641 B2
(45) Date of Patent: Jun. 1, 2010

(54) IMAGING FORMING APPARATUS

(75) Inventor: Hideaki Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 12/036,075

(22) Filed: Feb. 22, 2008

(65) Prior Publication Data

US 2008/0240757 A1 Oct. 2, 2008

(30) Foreign Application Priority Data

Mar. 29, 2007 (JP) ..... 2007-087339

(51) Int. Cl.
*G03G 15/08* (2006.01)
*G03G 15/00* (2006.01)
*G03G 15/04* (2006.01)

(52) U.S. Cl. ..... 399/254; 399/257; 399/82; 399/53; 399/167; 399/119

(58) Field of Classification Search ..... 399/36, 399/66, 85, 119, 227, 254, 256, 258, 257
See application file for complete search history.

(56) References Cited

U.S. PATENT DOCUMENTS

| | | | | |
|---|---|---|---|---|
| 4,615,612 | A * | 10/1986 | Ohno et al. | 399/227 |
| 4,940,014 | A * | 7/1990 | Saijo et al. | 399/256 |
| 5,162,849 | A * | 11/1992 | Yoshino et al. | 399/29 |
| 5,913,098 | A * | 6/1999 | Toyama | 399/257 |
| 7,013,096 | B2 * | 3/2006 | Ozawa et al. | 399/58 |
| 7,206,538 | B2 * | 4/2007 | Kumar et al. | 399/257 |
| 7,233,766 | B2 * | 6/2007 | Matsuyama et al. | 399/358 |
| 7,260,345 | B2 * | 8/2007 | Kamiya | 399/257 |
| 7,317,889 | B2 * | 1/2008 | Suzuki | 399/236 |
| 7,343,106 | B2 * | 3/2008 | Mitamura | 399/12 |
| 7,650,100 | B2 * | 1/2010 | Murata et al. | 399/253 |
| 2005/0025513 | A1 * | 2/2005 | Ichikawa et al. | 399/82 |
| 2006/0029405 | A1 * | 2/2006 | Tanaka et al. | 399/27 |
| 2007/0231015 | A1 * | 10/2007 | Sakamaki | 399/257 |
| 2007/0297832 | A1 * | 12/2007 | Sato | 399/254 |

FOREIGN PATENT DOCUMENTS

| | | |
|---|---|---|
| JP | 59-100471 B | 6/1984 |
| JP | 05-333691 A | 12/1993 |
| JP | 2005-292511 A | 10/2005 |

* cited by examiner

*Primary Examiner*—David M Gray
*Assistant Examiner*—Francis Gray
(74) *Attorney, Agent, or Firm*—Canon USA Inc IP Div

(57) ABSTRACT

An image forming apparatus includes a development container, a developer bearing member, first and second carrying members that carry developer, a supply device that supplies developer for replenishment, a discharge opening that discharges the developer contained in the development container, a controller that selectively performs one of a first mode and a second mode, a drive device that changes speeds for driving the first and second carrying members, and a counter that measures the number of sheets in the second mode. The controller sets the speed of the drive device in the second mode to be slower than in the first mode, and suspends the second mode and executes a mode for changing the speed of the drive device to a speed faster than in the second mode and driving the first and second carrying members for a predetermined time if a measurement result reaches a reference value.

6 Claims, 11 Drawing Sheets

IMAGING FORMING APPARATUS

BACKGROUND OF THE INVENTION

1. Field of the Invention

The present invention relates to an image forming apparatus, such as a copying machine, a printer and a facsimile machine, having a development device that is configured to develop an electrostatic image formed on an image bearing member using electrophotography, an electrostatic recording method, or the like.

2. Description of the Related Art

In image forming apparatuses that use electrophotography such as a copying machine, an electrostatic latent image formed on an image bearing member such as a photosensitive drum is visualized by depositing developer on the image. In the conventional development devices used for the development, development devices that use two-component developer have been known. The two-component developer is composed of toner and carrier. FIG. 10 is a cross sectional view illustrating an example of a conventional development device.

As illustrated in FIG. 10, a development device 101*d* that uses the two-component developer generally has two carrying screws arranged in a horizontal direction, that is, a first carrying screw 105 and a second carrying screw 106 that carry the two-component developer while agitating the developer. The first carrying screw 105 supplies the developer to a developer bearing member (hereinafter, referred to as development sleeve) 108 and collects the developer after the developer passes through a development area. The second carrying screw 106 mixes and agitates the developer collected by the development sleeve 108 and newly supplied developer.

Meanwhile, in recent years, in order to achieve space efficiency, a demand for downsizing the apparatus bodies of the image forming apparatuses is increasing. Especially, since full color image forming apparatuses have several development devices, the downsizing of the bodies is highly demanded. For this purpose, as discussed in Japanese Patent Application Laid-Open No. 5-333691, a vertical agitation type development device, for example, have been proposed, as illustrated in FIG. 11.

A development device 111 shown in FIG. 11 has a structure different from the development device 101*d* illustrated in FIG. 10, that is, carrying screws that function as carrying members for agitating and mixing two-component developer are vertically arranged in the direction of gravitational force. A first carrying screw 115 conveys the developer in a development chamber 113 that is arranged at an upper side of a development container and supplies the developer to a development sleeve 118. A second carrying screw 116 mixes and agitates the developer collected from the development sleeve 118 and newly supplied developer while carrying the developer in an agitation chamber 114 that is arranged at a lower side of the development container.

As described above, in the vertical agitation type development device, the development chamber and the agitation chamber are vertically arranged, and the occupancy space in the horizontal direction is small. Accordingly, for example, it is possible to downsize tandem type color image formation apparatuses that have a plurality of development devices arranged in parallel in the horizontal direction.

In the above development method that uses the two-component developer, an image is formed by applying electric charge to toner with frictional electrification of carrier and toner, and electrostatically attaching the charged toner to an electrostatic image. In the two-component development method, in order to provide highly durable and stable images, it is desirable to stably apply a certain amount of toner charge, that is, triboelectrification (hereinafter, simply referred to as tribo). For that purpose, it is desirable that the charging ability of the carrier is maintained to be stable between before and after prolonged use.

However, in reality, while the toner is constantly consumed in the development, the carrier remains in the development device without being consumed. Accordingly, in long-term use, the carrier is agitated with the toner for a long time, and the surface of the carrier can be contaminated by the toner or an external additive of the toner. As a result, after prolonged use, the ability of the carrier for supplying the tribo may be decreased and the tribo may be degraded. This can cause image deterioration such as fog and toner scatter.

Therefore, for example, as discussed in Japanese Examined Patent Application Laid-Open No. 2-21591, a device that can control the deterioration of the charging ability by supplying developer to development devices is proposed. That is, the supply device supplies new developer or carrier, and excessive developer in the development device is discharged from a developer discharging opening disposed on a wall surface of the development device. Then, the discharged developer is collected.

The devices sequentially repeat the supply of the new developer or carrier as well as the discharge of the developer to replace the deteriorated developer in the development devices with the newly supplied toner and carrier. Accordingly, the development characteristic of the developer in the development devices is generally maintained at a constant characteristic, and the image quality deterioration can be reduced. As a result, intervals of the replacement of the developer by serving staffs can be extended or the replacement can be eliminated.

However, if the developer discharge method discussed in Japanese Examined Patent Application Laid-Open No. 2-21591 is applied to an image forming apparatus having the above-described vertical-agitation development device, the following problems may occur.

In the case where developer is discharged in the vertical-agitation development device, a discharge opening of the developer can be provided on a wall surface of a container in a development chamber at a downstream side in a developer conveyance direction, and from the discharge opening, overflow developer is discharged and collected. If the discharge opening is provided at a place other than the wall surface, for example, in an agitation chamber, new carrier that has just been supplied may be immediately discharged. Alternatively, the discharge opening can be provided in the development chamber at an upstream side in the developer conveyance direction. However, in the above-described configuration, the position of the discharge opening is right behind a position where the developer is lifted from the agitation chamber to the development chamber, and a height of the developer surface in the development chamber may not be stable. Accordingly, appropriate discharge of the developer may not be performed.

As described above, in the case where the discharge opening of the developer is provided in the agitation chamber at the downstream side in the developer conveyance direction, if the developer surface exceeds the height of the discharge opening, the developer may overflow and be discharged. However, if the developer surface does not exceed the height of the discharge opening, the developer may not be discharged.

Meanwhile, in a case of forming an image on heavy paper or overhead transparency (OHT), some image forming apparatuses slow down the image formation speed as compared with normal image formation. For example, some image forming apparatuses have a deceleration mode that decreases an image formation speed to, for example, a half or one-third of a normal speed. In the deceleration mode in which a rotation speed of a photosensitive drum is decreased, generally, a drive speed of a development device is similarly decreased to, for example, a half or one-third of the normal drive speed.

In a case where a drive speed is decreased in the vertical-agitation development device in the deceleration mode, the number of rotations of the first and second carrying screws are reduced as compared with a normal mode. Accordingly, a developer conveyance speed is decreased. As a result, a development conveyance speed of the second carrying screw is also decreased, so that momentum of the developer to ascend from the agitation chamber to the development chamber is also decreased, and the amount of the developer lifted to the development chamber is decreased, too. Accordingly, in response to the decrease of the developer amount in the development chamber, the developer surface descends lower than in the normal case. Accordingly, the developer is not easily discharged from the developer discharge opening provided at the downstream side of the development chamber. Consequently, if the deceleration mode is continued, the amount of the developer in the development device is gradually increased. Accordingly, the developer accumulates especially at the lift portion in the agitation chamber.

If such a state is maintained, the pressure of the developer is increased at the lift portion, and the developer can leak from a lower part of the development sleeve or torque can be increased, which may cause the carrying screw to lock.

To avoid the problems, the developer discharge opening may be provided at a relatively lower part in consideration of the height of the developer in the development chamber at the time of the deceleration mode. However, in such a configuration, the developer may be excessively discharged in the normal image formation mode and the amount of the developer in the development device may become too small. Then, toner density may show a great variation when the toner is supplied, or the developer may be easily deteriorated.

SUMMARY OF THE INVENTION

An embodiment of the present invention is directed to an image forming apparatus that includes a development chamber above an agitation chamber, and a discharge opening that discharges developer contained in the development chamber, and can form an image at different speed modes. The image forming apparatus can stably discharge developer from the development chamber irrespective of operating speed modes set for image formations.

According to an aspect of the present invention, an image forming apparatus includes an image bearing member on which an electrostatic image is formed, a development container having a first chamber, a second chamber disposed below the first chamber, and first and second communication portions, and configured to contain developer including toner and carrier, a developer bearing member provided near the first chamber and configured to bear the developer and develop the electrostatic image, a first carrying member provided in the first chamber and configured to carry the developer from the first communication portion to the second communication portion, a second carrying member provided in the second chamber and configured to carry the developer from the second communication portion to the first communication portion, a supply device configured to supply developer for replenishment into the development chamber, a controller configured to selectively perform at least one of a first mode for moving a surface of the image bearing member at a first speed and forming an image and a second mode for moving the surface of the image bearing member at a second speed that is slower than the first speed and forming an image, a drive device capable of changing speeds for driving the first carrying member and the second carrying member, and a counter configured to measure the number of image-formed sheets in continuous image formation in the second mode. The controller sets the drive speed of the drive device in the second mode to be slower than in the first mode and suspends the second mode and executes a mode for changing the drive speed of the drive device to a speed faster than in the second mode and driving the first carrying member and the second carrying member in a case where a measurement result of the counter in the second mode reaches a reference value.

According to another aspect of the present invention, an image forming apparatus includes an image bearing member on which an electrostatic image is formed, a development container having a first chamber, a second chamber disposed below the first chamber, and first and second communication portions, and configured to contain developer including toner and carrier, a developer bearing member provided near the first chamber and configured to bear the developer and develop the electrostatic image, a first carrying member provided in the first chamber and configured to carry the developer from the first communication portion to the second communication portion, a second carrying member provided in the second chamber and configured to carry the developer from the second communication portion to the first communication portion, a supply device configured to supply developer for replenishment into the development chamber, a controller configured to selectively perform at least one of a first mode for moving a surface of the image bearing member at a first speed and forming an image, and a second mode for moving the surface of the image bearing member at a second speed that is slower than the first speed and forming an image, a drive device capable of changing speeds for driving the first carrying member and the second carrying member, and a counter configured to measure a drive time of the drive device in the second mode. The controller sets the drive speed of the drive device in the second mode to be slower than in the first mode and the controller suspends the second mode and executes a mode for changing the drive speed of the drive device to a speed faster than in the second mode and driving the first carrying member and the second carrying member in a case where a measurement result of the counter in the second mode reaches a reference value.

According to yet another aspect of the present invention, an image forming apparatus includes an image bearing member on which an electrostatic image is formed, a development container having a first chamber, a second chamber disposed below the first chamber, and first and second communication portions, and configured to contain developer including toner and carrier, a developer bearing member provided near the first chamber and configured to bear the developer and develop the electrostatic image, a first carrying member provided in the first chamber and configured to carry the developer from the first communication portion to the second communication portion, a second carrying member provided in the second chamber and configured to carry the developer from the second communication portion to the first communication portion, a supply device configured to supply developer for replenishment into the development chamber by driving a developer supply member, a controller configured to selectively perform at least one of a first mode for moving a surface of the image bearing member at a first speed and forming an image and a second mode for moving the surface of the image bearing member at a second speed that is slower than the first speed and forming an image, a drive device capable of changing speeds for driving the first carrying member and the second carrying member, and a counter configured to measure a drive time of the developer supply member in the second mode. The controller sets the drive speed of the drive device in the second mode to be slower than in the first mode and the controller suspends the second mode and executes a mode for changing the drive speed of the drive device to a speed faster than in the second mode and driving the first carrying member and the second carrying member in a case where a measurement result of the counter in the second mode reaches a reference value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EXEMPLARY EMBODIMENTS

Embodiments of the invention will be described in detail below with reference to the drawings.

First Exemplary Embodiment

Figure 1:
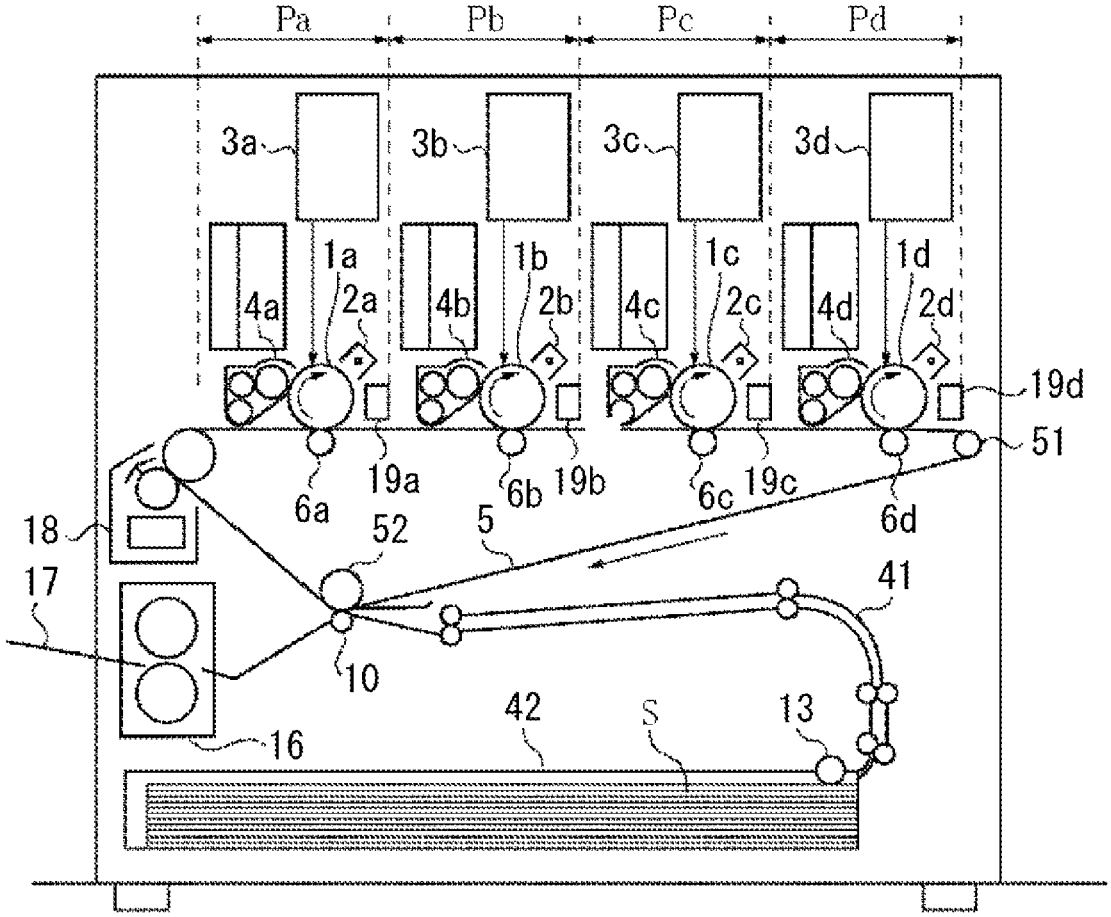
FIG. 1 is a block diagram illustrating a structure of an image forming apparatus according to a first exemplary embodiment of the present invention.

FIG. 1 illustrates a structure of a full-color image forming apparatus that employs an electrophotography method according to a first exemplary embodiment of the present invention.

In the first exemplary embodiment, the image forming apparatus includes four image forming sections P (Pa, Pb, Pc, and Pd). The image forming sections Pa to Pd include photosensitive drums 1 (1*a*, 1*b*, 1*c*, and 1*d*) (i.e., drum-shaped electrophotographic photoreceptors) that function as image bearing members and rotate in a direction of the arrow (counterclockwise direction). Around the photosensitive drums 1, charging devices 2 (2*a*, 2*b*, 2*c*, and 2*d*), laser beam scanners 3 (3*a*, 3*b*, 3*c*, and 3*d*), development devices 4 (4*a*, 4*b*, 4*c*, and 4*d*), primary transfer rollers 6 (6*a*, 6*b*, 6*c*, and 6*d*), and cleaning units 19 (19*a*, 19*b*, 19*c*, and 19*d*) are disposed. The charging devices 2 function as charging units that charge surfaces of the photosensitive drums 1. The laser beam scanners 3 are disposed above the photosensitive drums 1 and function as exposure units that expose the drum to light to form electrostatic images. The development devices 4 function as development units that develop the electrostatic images formed on the photosensitive drums 1 using developer. The primary rollers 6 function as primary transfer units that transfer the developer on the photosensitive drums 1 to an intermediate transfer member 5. The cleaning units 19 clean the developer remaining on the photosensitive drums 1. As described above, the image forming sections include the image bearing members, the charging units, the exposure units, the transfer units, the cleaning units, and the like.

Each of the image forming sections Pa, Pb, Pc, and Pd has a similar configuration. The photosensitive drums 1*a*, 1*b*, 1*c*, and 1*d* disposed in the image forming sections Pa, Pb, Pc have the same configuration. Accordingly, the photosensitive drums 1*a*, 1*b*, 1*c*, and 1*d* are generically referred to as a photosensitive drum 1. Similarly, each charging device, laser beam scanner, development device, transfer roller, and cleaning unit disposed in each image forming section have similar configurations. Accordingly, they are generically referred to as a charger 2, a laser beam scanner 3, a development device 4, a transfer roller 6, and a cleaning unit 19.

An image formation sequence (image formation operation) of the image formation apparatus in a first mode, that is, a normal mode is described.

First, the photosensitive drum 1 is uniformly charged by the charger 2. In the normal mode, the photosensitive drum 1 rotates at a process speed (peripheral velocity) of 286 mm/sec in a clockwise direction indicated by the arrow.

The uniformly charged photosensitive drum 1 is exposed and scanned by the laser beam scanner 3 with a laser beam that an image signal modulates. The laser beam scanner 3 includes a semiconductor laser. The semiconductor laser is controlled according to an original document image information signal output by an original document reading device having a photoelectric conversion element such as a charge coupled device (CCD), and emits a laser beam.

In the above operation, a surface potential of the photosensitive drum 1 charged by the charger 2 is changed at the image part, and an electrostatic image is formed on the photosensitive drum 1. The electrostatic image is inversely developed by the development device 4 and a visible image, that is, a toner image is formed.

In the first exemplary embodiment, the development device 4 employs a two-component developing method that uses mixed developer of toner and carrier.

The above-described process is performed in each of the image forming sections Pa, Pb, Pc, and Pd, and toner images of four colors, that is, yellow, magenta, cyan, and black, are formed on the photosensitive drums 1*a*, 1*b*, 1*c*, and 1*d*.

In the first exemplary embodiment, on lower sides of the image forming sections Pa, Pb, Pc, and Pd, an intermediate transfer belt 5 that functions as the intermediate transfer member is disposed. The intermediate transfer belt 5 is suspended by rollers 51, 52, and 53, and can freely move in the arrow direction.

The toner images on the photosensitive drum 1 (1*a*, 1*b*, 1*c*, and 1*d*) are once transferred onto the intermediate transfer belt 5 by the transfer roller 6 (6*a*, 6*b*, 6*c*, and 6*d*) that function as the primary transfer unit. Thus, the toner images of four colors, that is, yellow, magenta, cyan, and black, are overlaid on the intermediate transfer belt 5, and a full-color image is formed. The toner that is not transferred and remaining on the photosensitive drum 1 is collected by the cleaning unit 19.

The full-color image formed on the intermediate transfer belt 5 is transferred onto a transfer material S by an operation of a secondary transfer roller 10 that functions as a secondary transfer unit. The transfer material S is, for example, paper taken out from a paper cassette 42 and conveyed through a paper feeding roller 13, and a paper feeding guide 41. The toner that is not transferred and remaining on the intermediate transfer belt 5 is collected by an intermediate transfer belt cleaning unit 18.

The transfer material S onto which the toner image is transferred is conveyed to a fixing device (thermal roller fixing device) 16, and the image is fixed. Then, the transfer material S is discharged onto a discharge tray 17.

In the first exemplary embodiment, as the image bearing member, the photosensitive drum 1 that is generally drum-shaped organic photoreceptor is used. However, inorganic photoreceptors such as an amorphous silicon photoreceptor can also be used. Further, a belt-shaped photoreceptor can also be used. Further, the above-described transfer method, cleaning method, and fixing method are not limited to the above-described methods.

Figure 2:
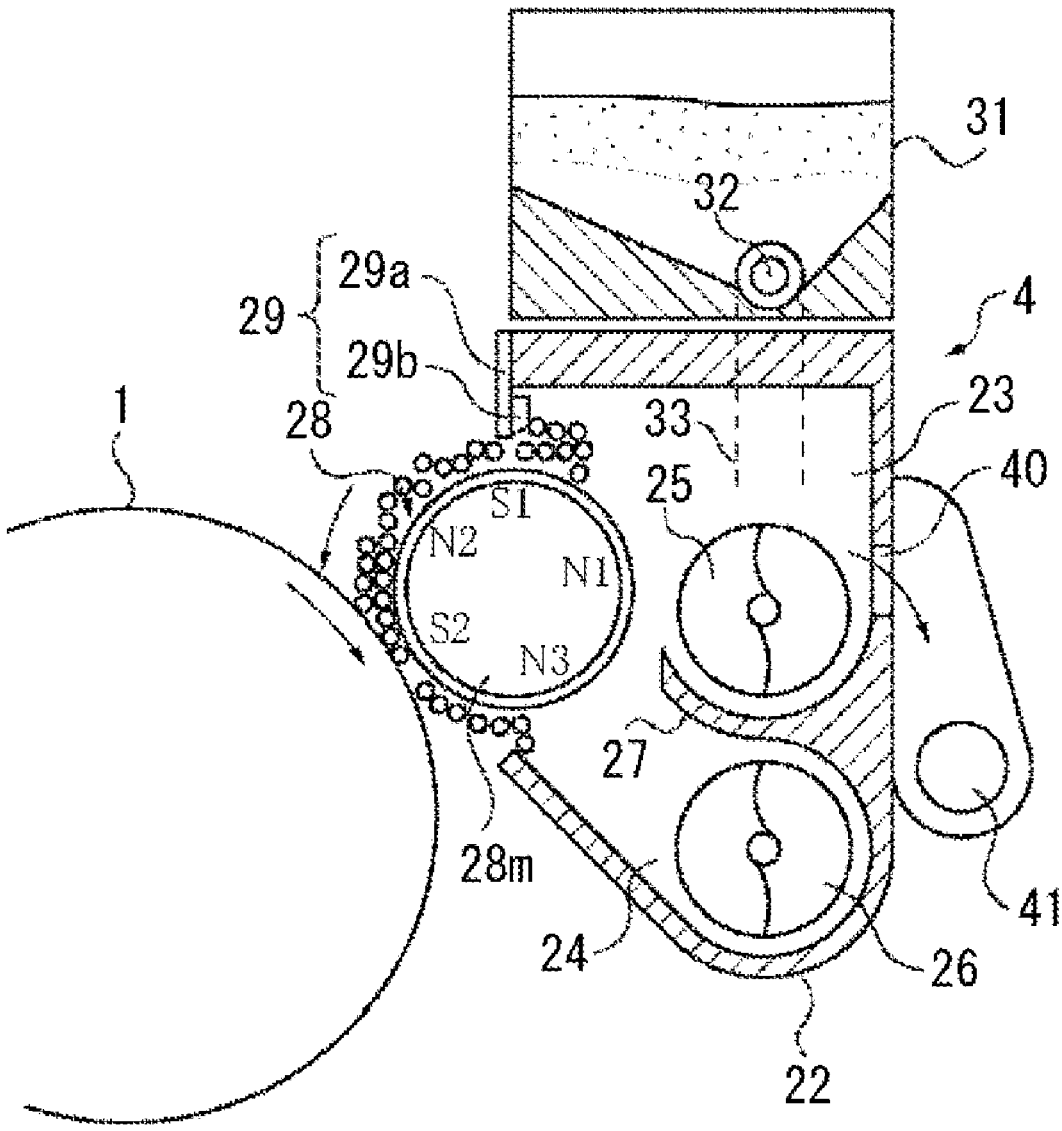
FIG. 2 is a sectional side view illustrating a development device according to the first exemplary embodiment of the present invention.
Figure 3:
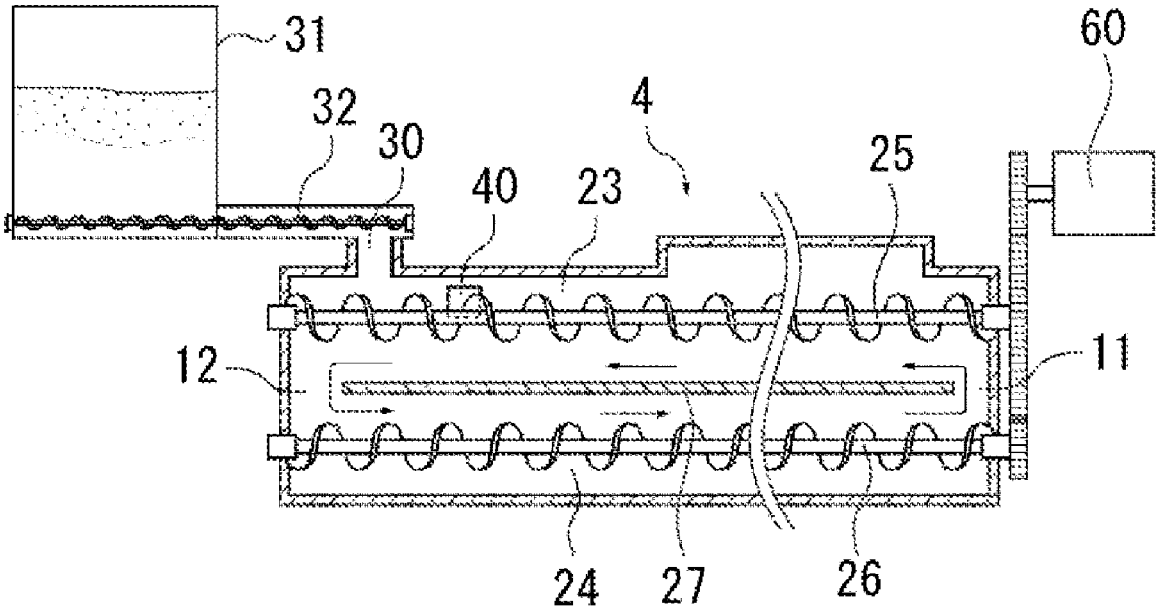
FIG. 3 is a longitudinal sectional view illustrating the development device according to the first exemplary embodiment of the present invention.

With reference to FIGS. 2 and 3, an operation of the development device 4 is described. FIGS. 2 and 3 illustrate sectional views of the development device 4 according to the first exemplary embodiment. The development device 4 is a so-called vertical-agitation type.

The development device 4 according to the first exemplary embodiment includes a development container 22. The development container 22 contains, as developer, two-component developer that includes toner and carrier. The development container 22 includes a development sleeve 28 that functions as a development bearing member, and a regulation member (ear-cutting member) 29 that regulates a height of an ear of the developer born by the development sleeve 28.

In the first exemplary embodiment, the inside of the development container 22 is vertically divided into a first chamber (development chamber) 23 and a second chamber (agitation chamber) 24 by a partition wall 27 that extends in a rotation axis direction of the development sleeve. The developer is contained in the development chamber 23 and the agitation chamber 24.

In the first chamber (development chamber) 23, a first carrying screw 25 (i.e., a first carrying member) is disposed. In the second chamber (agitation chamber) 24, a second carrying screw 26 (i.e., a second carrying member) is disposed. The first carrying screw 25 is disposed substantially in parallel along an axis of the development sleeve 28 at a bottom of the development chamber 23, and rotates to convey the developer in the development chamber 23 along the axis in one direction. The second carrying screw 26 is disposed substantially in parallel with the first carrying screw 25 at a bottom of the agitation chamber 24, and conveys the developer in the agitation chamber 24 in a direction opposite to the first carrying screw 25. The first carrying screw 25 and the second carrying screw 26 are connected with each other by a motor 60 that functions as a drive device, and via gear train, and driven by drive force from the motor 60. The motor 60 can change drive speeds. In response to the change in the drive speeds of the motor 60, drive speeds of the first screw 25 and the second screw 26 are changed. The development sleeve 28 may also be driven and rotated by the drive force supplied from the motor 60.

As described above, conveyed by the rotation of the first and second carrying screws 25 and 26, the developer goes in cycles between the development chamber 23 and the agitation chamber 24 through a first communication portion 11 and a second communication portion 12 that are provided at both ends of a partition wall 27. That is, the first carrying screw 25 conveys the developer from the first communication portion 11 to the second communication portion 12. The second carrying screw 26 conveys the developer from the second communication portion 12 to the first communication portion 11.

Diameters of the first and second carrying screws 25 and 26 are 18 mm, and their pitches are 20 mm respectively. In the normal mode, the screws 25 and 26 rotate at the rotation number (rotation velocity) of 390 rpm respectively.

In the first exemplary embodiment, an opening is provided in the development container 22 at a position corresponding to a development area opposed to the photosensitive drum 1. A development sleeve 28 is rotatably disposed at the opening so that the development sleeve 28 is partially exposed in a photosensitive drum direction The development sleeve 28 is provided near the first chamber 23 and the developer in the first chamber 23 is supplied to the development sleeve 28.

In the first exemplary embodiment, a diameter of the development sleeve 28 is set to 20 mm, and a diameter of the photosensitive drum 1 is set to 40 mm. In a closest area, a distance between the development sleeve 28 and the photosensitive drum 1 is set about 400 μm. Thus, development can be performed in a state that the developer conveyed to the development part comes in contact with the photosensitive drum 1. The development sleeve 28 is formed of a nonmagnetic material such as aluminum or stainless steel. Within the development sleeve 28, a magnet roller 28*m* that functions as a magnetic field unit is installed in an irrotational state. The magnet roller 28*m* has a development magnetic pole S2 that is disposed opposite to the photosensitive drum 1 in the development part and a magnetic pole S1 that is disposed opposite to the ear-cutting member 29. Further, the magnet roller 28*m* has a magnetic pole N2 that is disposed between the magnetic poles S1 and S2, and magnetic poles N1 and N3 that are disposed opposite to the development chamber 23 and the agitation chamber 24 respectively. The number of rotations of the development sleeve in the normal mode is set to 250 rpm.

The development sleeve 28 rotates in a direction indicated by the arrow (counterclockwise) as illustrated in the drawing at development, and bears the two-component developer, the layer thickness of which the ear-cutting member 29 regulates by ear-cutting a magnetic brush. Then, the development sleeve 28 conveys the born developer to the development area that is opposite to the photosensitive drum 1, supply the developer to an electrostatic image formed on the photosensitive drum 1, and thus the development is performed.

The regulation blade 29 includes a nonmagnetic member 29*a* that is formed of, for example, aluminum extending along a rotational axis of the development sleeve 28, and a magnetic member 29*b* formed of, for example, an iron material. The regulation blade 29 is disposed upstream from the photosensitive drum 1 in the development sleeve rotation direction. Both of the toner and carrier of the developer are passed through a space between a tip of the regulation blade 29 and the development sleeve 28, and conveyed to the development area. The amount of the developer carried to the development area is controlled by adjusting the space between the tip of the regulation blade 29 and the surface of the development sleeve 28 to regulate the amount of ear-cutting of the developer magnetic brush supported by the development sleeve 28. In the first exemplary embodiment, the regulation blade 29 regulates a developer coating amount per unit area on the development sleeve 28 to be 30 mg/cm$^2$. The space between the regulation blade 29 and the development sleeve 28 is set to 200 to 1000 μm, desirably, 400 to 700 μm. In the first exemplary embodiment, the space is set to 600 μm.

Figure 4:
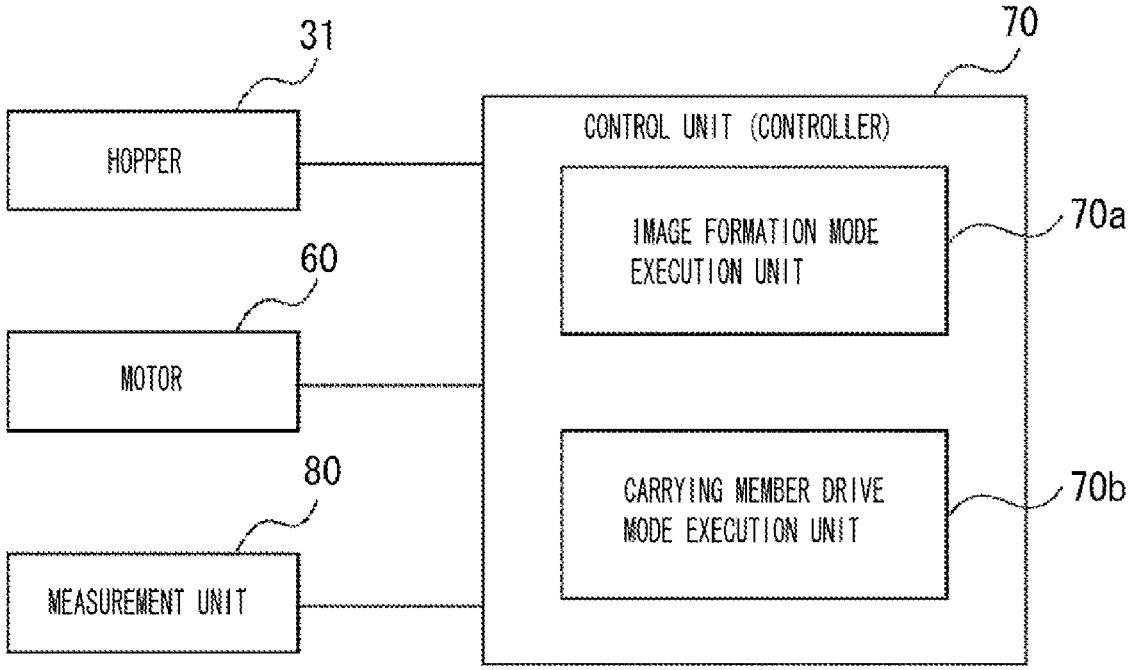
FIG. 4 is a block diagram illustrating a control structure according to the first exemplary embodiment of the present invention.

A developer supply method according to the first exemplary embodiment is described with reference to FIGS. 2 to 4.

At an upper part of the development device 4, a hopper 31 is disposed. The hopper 31 contains two-component developer that contains toner and carrier for supply. The hopper 31 that functions as a supply device includes a supply screw 32 that is a developer supply member at a lower part. One end of the supply screw 32 extends to a developer supply opening 30 that is provided at an anterior end of the development device 4.

An amount of the toner consumed in the image formation operation is replenished into the development container from the hopper 31 through the developer supply opening 30 by a rotational force of the supply screw 32 and the gravity of the developer. Thus, the developer for replenishment is supplied from the hopper 31 to the development device 1.

The amount of supply of the developer is substantially determined based on the number of rotations of the supply screw 32. The number of rotations is controlled by a control unit (controller) 70. As a measurement unit (counter) 80 that measures the number of rotations or rotation time of the supply screw 32, the following devices can be used. For example, to measure the number of rotations, a rotary encoder can be used. To measure the rotation time of the supply screw 32, for example, a unit for measuring drive time of a motor that drives the supply screw 32 can be used. As the method for controlling the toner supply amount, a toner density of the two-component developer is optically or magnetically detected, or a reference latent image on the photosensitive drum 1 is developed and a density of the toner image is detected. Based on the information of the toner density thus detected using the above-described methods, the supply control can be performed. However, other methods can also be used where deemed appropriate.

A method for discharging developer from the development chamber according to the first exemplary embodiment is described with reference to FIGS. 2 to 4.

A developer discharge opening 40 that forms a developer discharge unit is provided on a wall surface in the development chamber of the development device 4 at a downstream side in a developer conveyance direction. From the developer discharge opening 40, deteriorated developer is discharged in a direction indicated by the arrow. As the developer in the development device 4 is increased by the developer supply process, corresponding to the increased amount of the developer, the developer overflows and is discharged from the developer discharge opening 40. The discharged developer is conveyed to a collected developer container (not shown) by a collection screw 41 that functions as a carrying member.

The developer discharge opening 40 is formed upstream from the developer supply opening 30 in the developer conveyance direction. The developer discharge opening 40 is arranged as described above, to prevent the newly supplied developer from being immediately discharged, and to discharge the developer where the height of the developer is stable. The position and the size of the developer discharge opening 40 are appropriately determined depending on image forming apparatuses.

The apparatus according to the first exemplary embodiment has at least two image formation modes. One of the two modes is the first mode (normal mode) for forming an image on normal paper. In the first mode, an image is formed while the surface of the photosensitive drum 1 moves at the peripheral velocity of the first speed (286 mm/sec). Another mode is a second mode (deceleration mode) for forming an image on heavy paper or OHT sheets. In the second mode, the image is formed while the photosensitive drum 1 moves at the peripheral velocity of a second speed (process speed of 143 mm/sec), that is slower than the first speed.

An image formation mode execution unit (controller) 70*a* can selectively execute one of the image formation modes.

In the deceleration mode, not only the photosensitive drum 1, but also the speeds of the intermediate transfer belt 5 and the fixing device 16 are decreased to half of the speed in the normal mode. Accordingly, it is possible to sufficiently perform the transfer and fixation on transfer medium that is inferior to normal paper in transferability and fixability.

Figure 5:
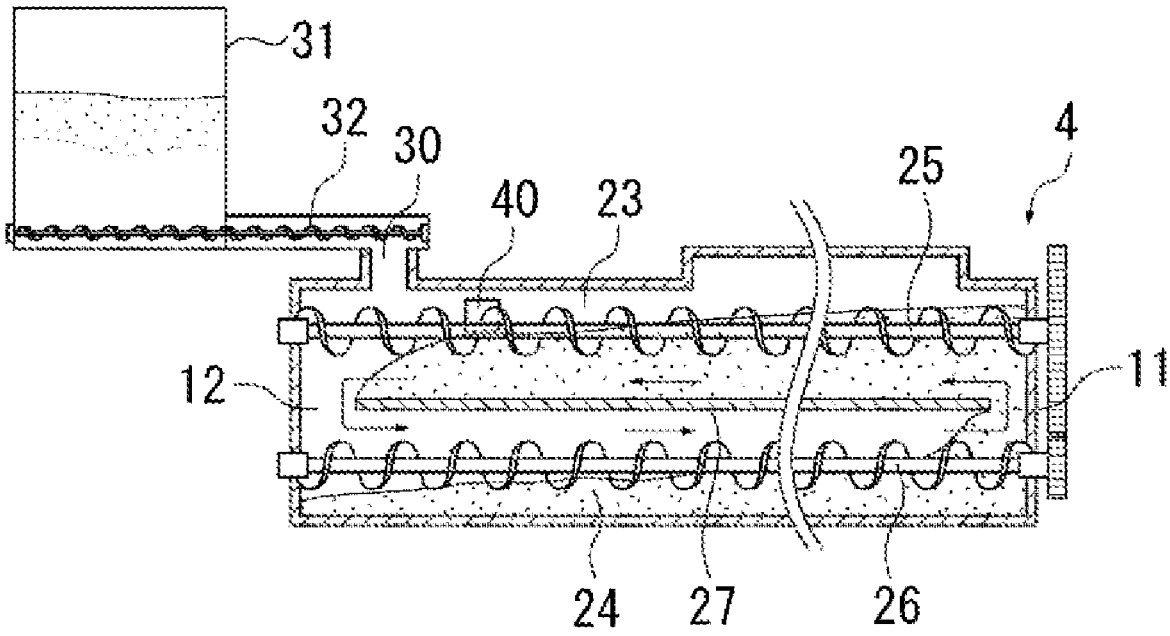
FIG. 5 is a view illustrating a height of a development surface in a normal mode according to the first exemplary embodiment of the present invention.
Figure 6:
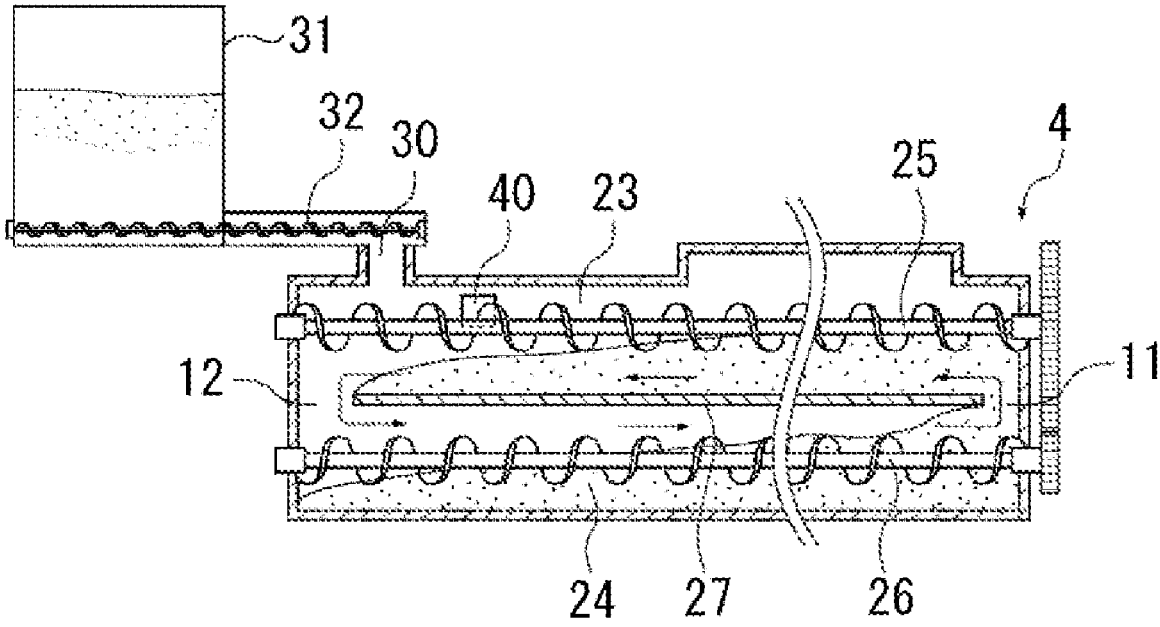
FIG. 6 is a view illustrating a height of a development surface in a deceleration mode according to the first exemplary embodiment of the present invention.

In the deceleration mode, the drive speed of the development device 4 is also reduced to the half speed of the normal mode. By the reduction of the drive speed, the development sleeve rotates at the rotation number of 125 rpm, and the first and second carrying screws rotate at 195 rpm, that is, at half speeds of the normal mode. Then, as described above, the movement speed of the developer conveyed by the second carrying screw 26 is slowed, and it becomes difficult to lift the developer in the lifting portion (first communication portion) 11. Accordingly, if the deceleration mode is continued for a while, the developer surface in the development chamber 23 falls, and on the contrary, the developer surface in the agitation chamber 24 rises. FIG. 5 illustrates the state of the developer in the normal mode. FIG. 6 illustrates the state of the developer in the deceleration mode.

Figure 7:
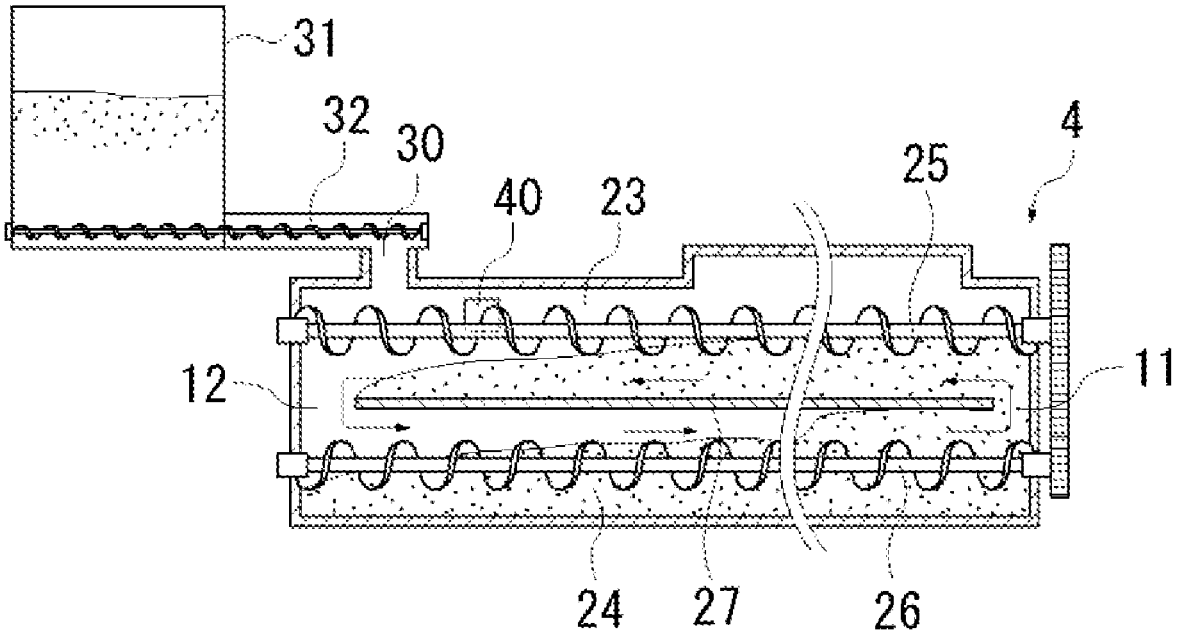
FIG. 7 is a view schematically illustrating a height of a development surface in a case where the deceleration mode is continued according to the first exemplary embodiment of the present invention.

As can be understood from FIG. 6, in the deceleration mode, the developer surface near the developer discharge opening 40 also falls. Accordingly, even if the amount of the developer in the development device is increased by supplying developer, it is difficult to discharge the developer. Therefore, if the deceleration mode is continued for a long time, the developer amount is excessively increased, and as illustrated in FIG. 7, the increased developer accumulates especially at the downstream side of the agitation chamber 24 in the developer conveyance direction. In this state, the pressure of the developer at the downstream side of the agitation chamber is increased, and the developer leaks from the space between the lower part of the development sleeve 28 and the container 22 to the outside or the torque applied to the second carrying screw 26 is increased, which may lock the screw.

Accordingly, in the first exemplary embodiment, in the deceleration mode, the measurement unit (counter) 80 that measures the number of image-formed sheets in successive image formation is provided. Based on a measurement result by the measurement unit 80, a carrying member drive mode (discharge mode) is performed. In the carrying member drive mode, the first and second carrying screws 25 and 26 are driven for a predetermined time at a same speed as the normal mode to discharge the developer. The discharge mode is performed by a carrying member drive mode execution unit (controller) 70*b*.

Figure 8:
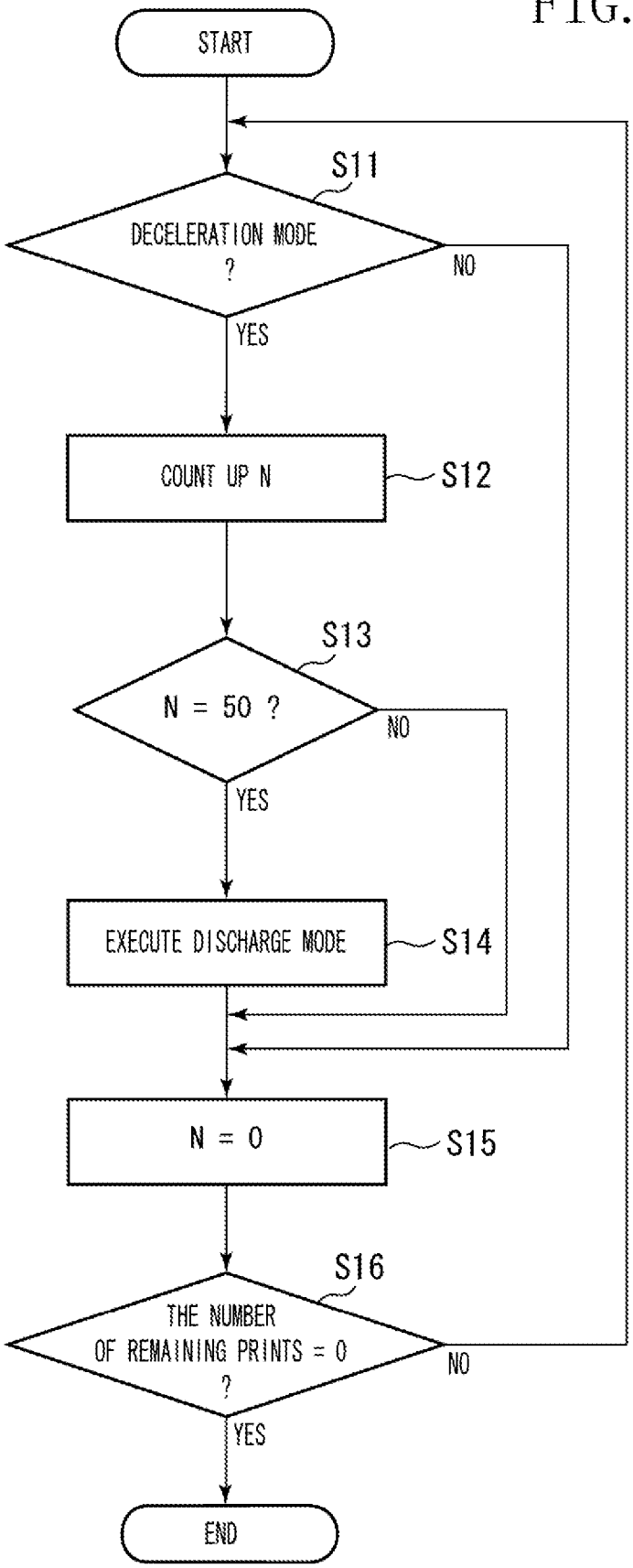
FIG. 8 is a view illustrating a control operation according to the first exemplary embodiment of the present invention.

An execution method of the discharge mode is described in detail with reference to FIG. 8.

In response to a start of image formation, in step S11, if the control unit 70 detects that an image formation mode is set to the deceleration mode (YES in step S11), in step S12, the measurement unit (counter) 80 that measures the number of successively image-formed sheets, starts to count up N. In the count, if a transfer medium on which an image is formed is a small size, the measurement unit 80 counts one. If the transfer medium is a large size, the measurement unit 80 counts two. When the number of successively image-formed sheets in the deceleration mode reaches a reference value (50 counts) (YES in step S13), in step S14, the control unit 70 temporarily suspends the image formation in the deceleration mode, and transfers to the discharge mode.

In the discharge mode, the control unit 70 increases the drive speed of the development device 4 to a same speed (the rotation number of the carrying screw: 390 rpm) as the normal mode, and drives the screws for a predetermined time (for example, 6 seconds) to raise the developer surface in the development chamber 23 and stimulate the discharge of the developer. When the discharge mode is finished, the control unit 70 returns the drive speed to the speed of the deceleration mode, and starts and continues the image formation in the deceleration mode. Once the discharge mode is performed, in step S15, the measurement unit (counter) 80 resets the count value N to zero, and starts the count-up again.

In a case where the normal mode is executed before the count value N reaches 50 sheets counted in a small size, the measurement unit (counter) 80 resets the count value N to zero. In step S16, the control unit 70 repeats the above-described operation until the number of remaining sheets becomes zero.

Figure 9:
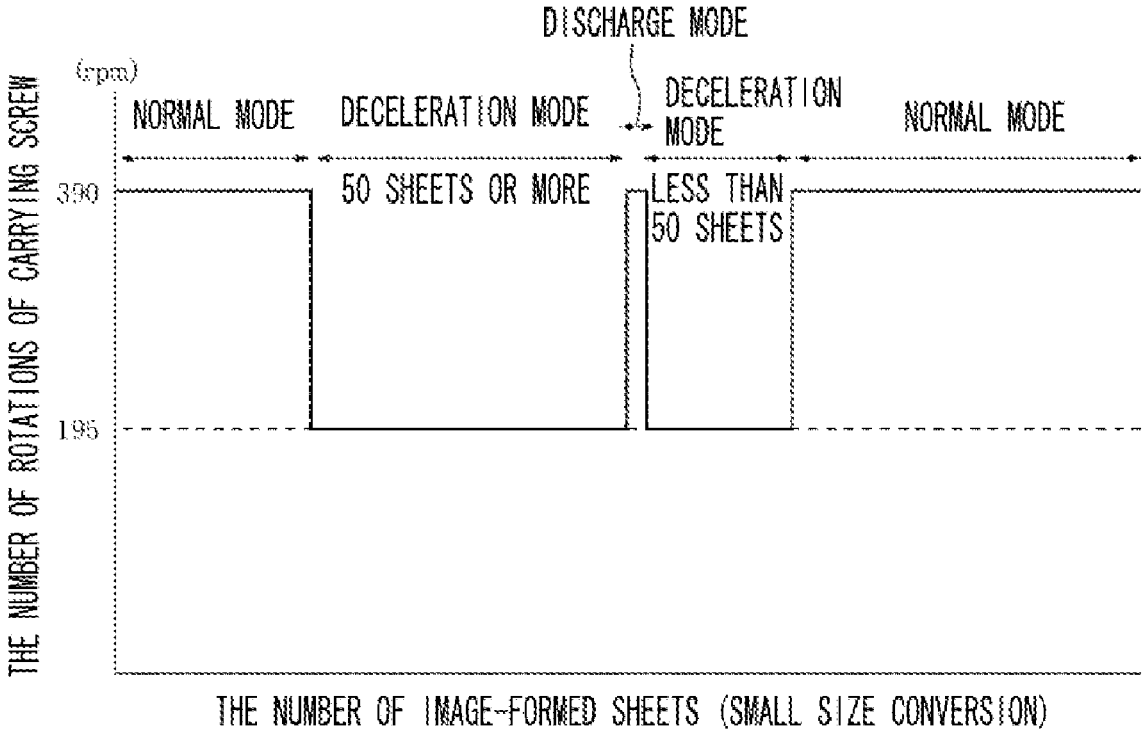
FIG. 9 is a view illustrating a timing chart in the control operation according to the first exemplary embodiment of the present invention.
Figure 10:
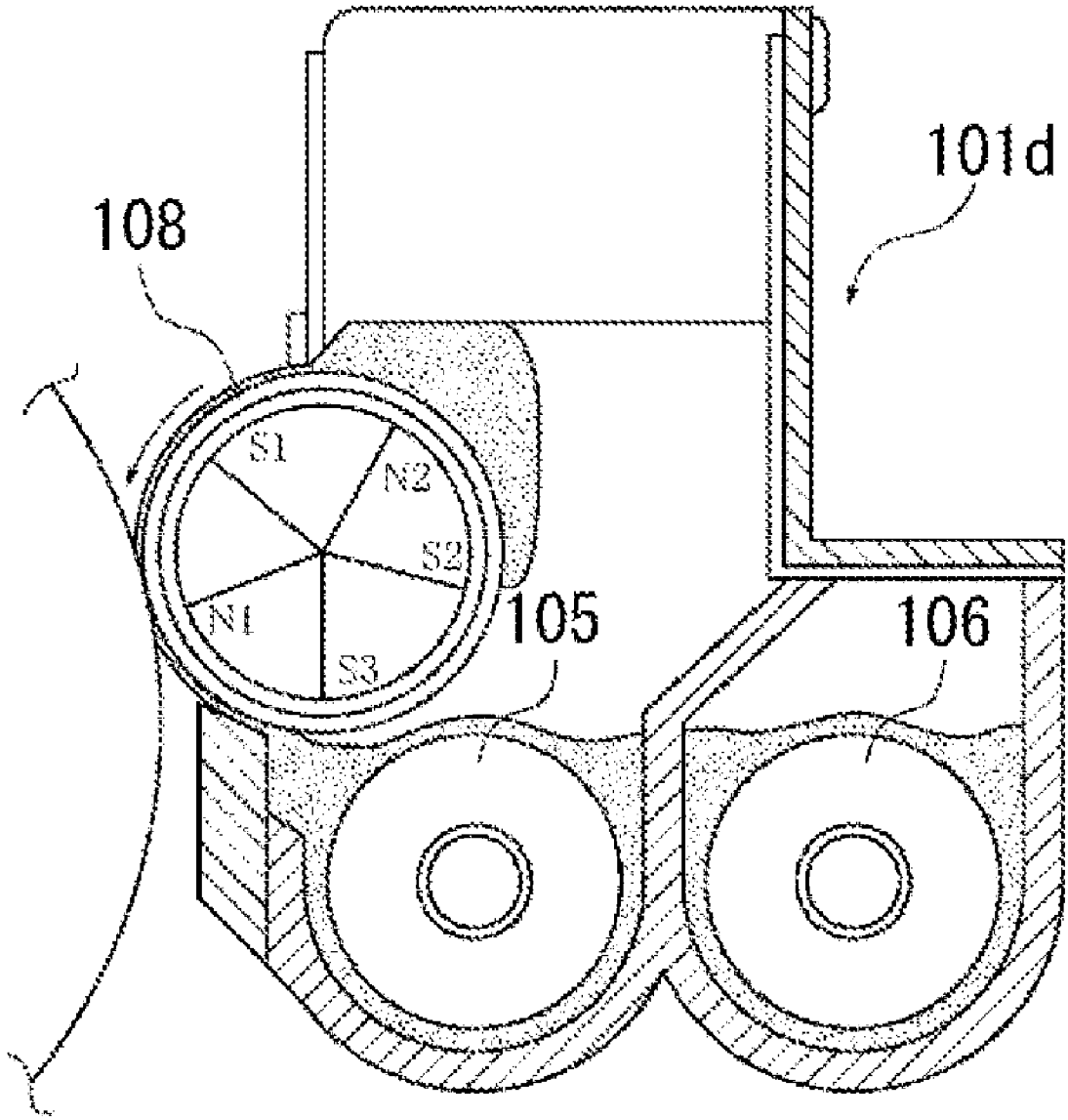
FIG. 10 PRIOR ART
FIG. 10 is a view illustrating a conventional development device.
Figure 11:
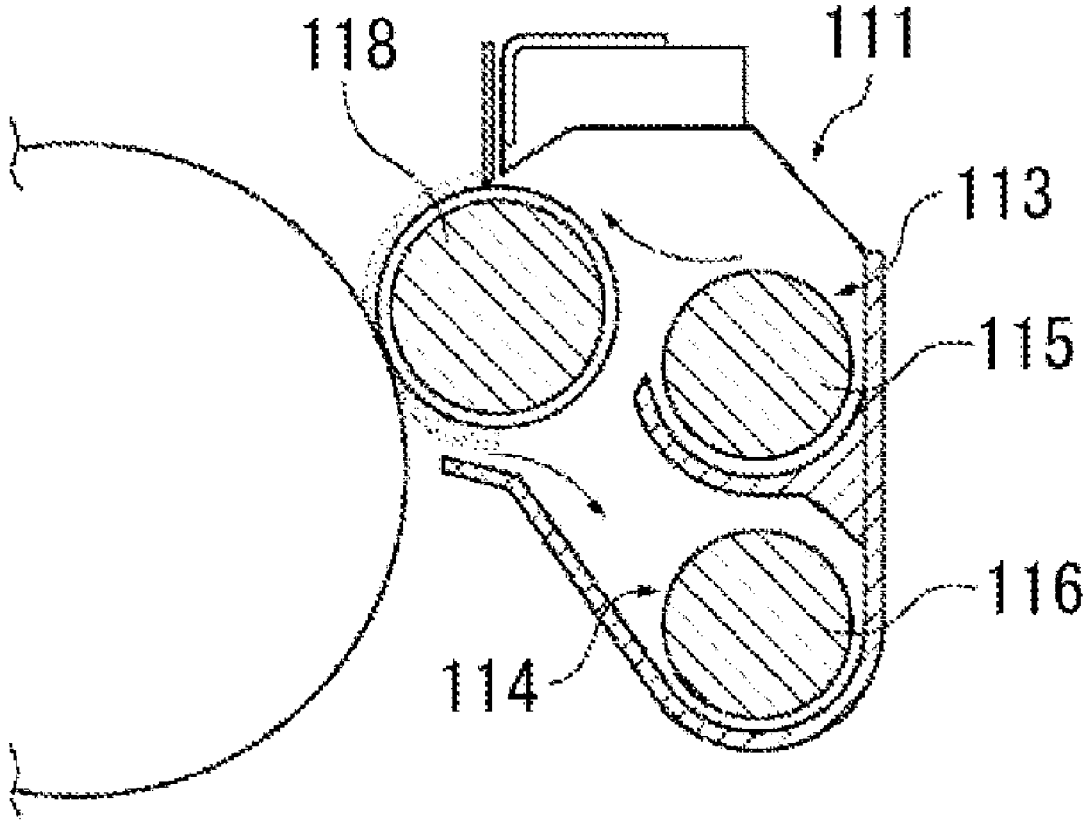
FIG. 11 PRIOR ART
FIG. 11 is a view illustrating a conventional vertical-agitation type development device.

FIG. 9 is a timing chart illustrating the sequence of the drive speed switch of the development device 4.

The rotation time of the carrying screws in the discharge mode is not limited to the above embodiment, and an optimal time is appropriately set depending on structures or drive speeds of the development device to be used.

The effects of an embodiment of the present invention can be achieved by setting the carrying screw drive speed in the discharge mode faster than in the deceleration mode. Accordingly, it is not necessary to set the carrying screw drive speed in the discharge mode to the same as the normal mode.

Further, in the first exemplary embodiment, the discharge mode is performed based on the number of image-formed sheets counted by the measurement unit 80 when an image is successively formed in the deceleration mode. However, the discharge mode can also be performed in a case where the measurement unit (counter) 80 counts the rotation time (drive time of the motor 60) of the carrying screws in the deceleration mode, and a measurement result of the rotation time reaches a reference value (reference time).

As described above, in the case where the deceleration mode is continued for a predetermined time or until the number of image-formed sheets reaches a predetermined value, the discharge mode is performed to raise the developer surface in the development chamber 23 and discharge the developer. As a result, it is possible to prevent the developer from excessively accumulating in the development device 4, especially at the downstream side of the agitation chamber 24.

Second Exemplary Embodiment

A second exemplary embodiment of the present invention is similar to the first exemplary embodiment in structures of the image forming apparatus and the development device, and also similar in that the discharge mode for driving the development device at a drive speed faster than the deceleration mode is provided. However, the second exemplary embodiment differs from the first exemplary embodiment in that as a trigger for transferring to the discharge mode, a drive time (rotation time) of the supply screw 32 that supplies the developer into the development device is used.

In response to a start of image formation, if the control unit 70 detects that an image formation mode is set to the deceleration mode, the measurement unit (counter) 80 starts to measure a drive time (total time) that the supply screw 32 is driven (rotated). The supply screw 32 supplies the toner when the deceleration mode is continued.

If a total value T of the drive time that the supply screw 32 is rotated, reaches a reference value (3.6 sec), the control unit 70 temporarily suspends the image formation in the deceleration mode, and transfers to the discharge mode. The discharge mode is performed by the carrying member drive mode execution unit (controller) 70*b*.

In the discharge mode, the control unit 70 increases the drive speed of the development device to the same speed (a rotation number of the carrying screw: 390 rpm) as the normal mode, and drives the screws for a predetermined time (6 seconds) to raise the developer surface in the development chamber 23 and discharge the developer. When the discharge mode is finished, the control unit 70 returns the drive speed to the speed in the deceleration mode, and starts and continues the image formation in the deceleration mode. Once the discharge mode is performed, the measurement unit (counter) 80 resets the total value T to zero, and starts the count-up again. If the normal mode is performed before the total value T reaches to 3.6 sec, the measurement unit (counter) 80 resets the total value T to zero.

In the case of the first exemplary embodiment, the timing to transfer to the discharge mode is controlled based on the number of image-formed sheets. According to the first exemplary embodiment, the following phenomenon occurs. If images having high image ratios are frequently printed in the deceleration mode, a large amount of the developer needs to be supplied. Therefore, the amount of the developer in the development device increases in a relatively short time after the mode is switched to the deceleration mode. In such a case, it is necessary to switch the mode early to the discharge mode to discharge the developer.

Further, in the deceleration mode, if images having low image ratios are frequently printed, only a small amount of the developer is supplied. Therefore, the amount of the developer in the development device does not excessively increase for some time after the mode is switched to the deceleration mode. However, even in such a case, if the mode is switched to the discharge mode according to the number of sheets, the image formation may be suspended although the amount of the developer has not much increased. Accordingly, unnecessary down-time occurs.

In view of the above, in the second exemplary embodiment, the execution of the discharge mode is controlled based on the drive time of the supply screw 32 in the continuous execution of the deceleration mode. Consequently, the developer discharge can be performed corresponding to the supplied developer amount.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-087339 filed in Mar. 29, 2007 which is hereby incorporated by reference herein in its entirety.

What is claimed:

1. An image forming apparatus comprising:

an image bearing member on which an electrostatic image is formed;

a development container having a first chamber, a second chamber disposed below the first chamber, and a first communication path and a second communication path for communicating the first chamber and the second chamber, and configured to contain developer;

a developer bearing member provided near the first chamber and configured to bear the developer and develop the electrostatic image;

a first carrying member provided in the first chamber and configured to carry the developer from the first communication portion to the second communication portion;

a second carrying member provided in the second chamber and configured to carry the developer from the second communication portion to the first communication portion;

a supply device configured to supply developer for replenishment into the development chamber;

a controller configured to selectively perform at least one of a first mode for moving a surface of the image bearing member at a first speed and forming an image, and a second mode for moving the surface of the image bearing member at a second speed that is slower than the first speed and forming an image;

a drive device capable of changing speeds for driving the first carrying member and the second carrying member; and a counter configured to measure the number of image-formed sheets in continuous image formation in the second mode, wherein the controller sets the drive speed of the drive device in the second mode to be slower than in the first mode;

the controller, in a case where a measurement result of the counter in the second mode reaches a reference value, suspends the second mode and executes a third mode for driving the first carrying member and the second carrying member for the predetermined time at speed faster than in the second mode, and wherein the counter resets the measurement result in a case where the third mode is performed.

2. The image forming apparatus according to claim 1, wherein the controller restarts the suspended second mode in a case where the third mode is finished.

3. An image forming apparatus comprising:

an image bearing member on which an electrostatic image is formed;

a development container having a first chamber, a second chamber disposed below the first chamber, and a first communication path and a second communication path for communicating the first chamber and the second chamber, and configured to contain developer;

a developer bearing member provided near the first chamber and configured to bear the developer and develop the electrostatic image;

a first carrying member provided in the first chamber and configured to carry the developer from the first communication portion to the second communication portion;

a second carrying member provided in the second chamber and configured to carry the developer from the second communication portion to the first communication portion;

a supply device configured to supply developer for replenishment into the development chamber;

a controller configured to selectively perform at least one of a first mode for moving a surface of the image bearing member at a first speed and forming an image, and a second mode for moving the surface of the image bearing member at a second speed that is slower than the first speed and forming an image;

a drive device capable of changing speeds for driving the first carrying member and the second carrying member; and a counter configured to measure a drive time of the drive device in the second mode, wherein the controller sets the drive speed of the drive device in the second mode to be slower than in the first mode;

the controller, in a case where a measurement result of the counter in the second mode reaches a reference value, suspends the second mode and executes a third mode for driving the first carrying member and the second carrying member for the predetermined time at speed faster than in the second mode, and wherein the counter resets the measurement result in a case where the third mode is performed.

4. The image forming apparatus according to claim 3, wherein the controller restarts the suspended second mode in a case where the third mode is finished.

5. An image forming apparatus comprising:

an image bearing member on which an electrostatic image is formed;

a development container having a first chamber, a second chamber disposed below the first chamber, and a first communication path and a second communication path for communicating the first chamber and the second chamber, and configured to contain developer;

a developer bearing member provided near the first chamber and configured to bear the developer and develop the electrostatic image;

a first carrying member provided in the first chamber and configured to carry the developer from the first communication portion to the second communication portion;

a second carrying member provided in the second chamber and configured to carry the developer from the second communication portion to the first communication portion;

a supply device configured to supply developer for replenishment into the development chamber by driving a developer supply member;

a controller configured to selectively perform at least one of a first mode for moving a surface of the image bearing member at a first speed and forming an image, and a second mode for moving the surface of the image bearing member at a second speed that is slower than the first speed and forming an image;

a drive device capable of changing speeds for driving the first carrying member and the second carrying member; and a counter configured to measure a drive time of the developer supply member in the second mode, wherein the controller sets the drive speed of the drive device in the second mode to be slower than in the first mode;

the controller, in a case where a measurement result of the counter in the second mode reaches a reference value, suspends the second mode and executes a third mode for driving the first carrying member and the second carrying member for the predetermined time at speed faster than in the second mode, and wherein the counter resets the measurement result in a case where the third mode is performed.

6. The image forming apparatus according to claim 5, wherein the controller restarts the suspended second mode in a case where the third mode is finished.

* * * * *